US009644630B2

(12) United States Patent
Orzechowski et al.

(10) Patent No.: US 9,644,630 B2
(45) Date of Patent: May 9, 2017

(54) SUPERCHARGER WITH INTEGRATED CONTRACTION CHAMBER FOR NOISE ATTENUATION

(71) Applicants: Jeffrey M Orzechowski, Troy, MI (US); Ian McLean, Windsor (CA); Neil W Loughlin, Ortonville, MI (US); Sean A Keyes, Shelby Township, MI (US)

(72) Inventors: Jeffrey M Orzechowski, Troy, MI (US); Ian McLean, Windsor (CA); Neil W Loughlin, Ortonville, MI (US); Sean A Keyes, Shelby Township, MI (US)

(73) Assignee: FCA US LLC, Auburn Hills, MI (US)

( * ) Notice: Subject to any disclaimer, the term of this patent is extended or adjusted under 35 U.S.C. 154(b) by 105 days.

(21) Appl. No.: 14/806,798

(22) Filed: Jul. 23, 2015

(65) Prior Publication Data

US 2017/0022991 A1 Jan. 26, 2017

(51) Int. Cl.

| | |
|---|---|
| ***F01C 13/00*** | (2006.01) |
| ***F04C 29/06*** | (2006.01) |
| ***F04C 18/16*** | (2006.01) |

(52) U.S. Cl.

CPC ..... *F04C 29/065* (2013.01); *F04C 18/16* (2013.01)

(58) Field of Classification Search

CPC ..... F04C 29/065; F04C 18/16

See application file for complete search history.

(56) References Cited

U.S. PATENT DOCUMENTS

| | | | | |
|---|---|---|---|---|
| 6,783,579 | B2 | 8/2004 | Pettipiece | |
| 7,832,993 | B2 * | 11/2010 | Erfurt | F02M 35/1288 123/559.1 |
| 8,142,172 | B2 * | 3/2012 | Forster | F04C 29/061 181/403 |
| 2006/0165543 | A1 * | 7/2006 | Fox | F04C 18/023 418/201.1 |
| 2008/0056882 | A1 * | 3/2008 | Clay | F02C 6/12 415/55.6 |
| 2008/0060622 | A1 | 3/2008 | Prior | |
| 2015/0004015 | A1 * | 1/2015 | Kienzle | F04C 29/061 417/312 |

FOREIGN PATENT DOCUMENTS

WO 2014/151452 A1 9/2014

OTHER PUBLICATIONS

International Search Report and Written Opinion dated Oct. 24, 2016 for International Application No. PCT/US206/041436, International Filing Date Jul. 8, 2016.

* cited by examiner

*Primary Examiner* — Jesse Bogue
(74) *Attorney, Agent, or Firm* — Ralph E. Smith

(57) ABSTRACT

A supercharger for a vehicle includes a lower body housing a compressor and an upper lid having a contraction chamber. The upper lid includes an air circulation port and is configured to be coupled to the lower body thereby forming a plenum. The contraction chamber is integrally formed in the upper lid adjacent to the air circulation port and includes an attenuator plate that defines a tuning neck. The tuning neck defines an inlet to and part of a volume of the contraction chamber, and includes a predetermined size and shape configured to attenuate a desired sound frequency generated by operation of the supercharger.

16 Claims, 9 Drawing Sheets

SUPERCHARGER WITH INTEGRATED CONTRACTION CHAMBER FOR NOISE ATTENUATION

FIELD

The present application relates generally to vehicle superchargers and, more particularly, to a supercharger for motor vehicle that includes an integrated contraction chamber for noise attenuation.

BACKGROUND

Forced induction systems, such as superchargers of the screw type, may be used in motor vehicle engine applications to increase the cylinder air charge to provide for increased engine output. Intake air typically enters the supercharger at near-atmospheric pressure. The engine intake air upstream or downstream of the supercharger may be subject to pressure pulsations inherent to operation of the supercharger. As a result, sound attenuation devices may be installed in the air intake system of the engine, upstream or downstream of the supercharger, in an effort to reduce noise generated by the supercharger pressure pulsations.

While such sound attenuation devices generally work for their intended purpose, these devices increase the cost and complexity of the powertrain, typically require packaging space that is often at a premium in motor vehicle under-hood applications, and are not positioned in an optimal location for the most effective reduction of supercharger generated noise.

SUMMARY

In accordance with an exemplary aspect of the invention, a supercharger for a vehicle is provided. In one implementation, the supercharger includes a lower body housing a compressor, and an upper lid having a contraction chamber. The upper lid is configured to be coupled to the lower body thereby forming a plenum, and the upper lid also includes an air circulation port. The contraction chamber is integrally formed in the upper lid adjacent to the air circulation port and includes an attenuator plate that defines a tuning neck. The tuning neck defines an inlet to and part of a volume of the contraction chamber. The tuning neck also includes a predetermined size and shape configured to attenuate one or more desired sound frequencies generated by operation of the supercharger.

In one exemplary implementation, the contraction chamber is formed entirely in the upper lid of the supercharger. In one exemplary implementation, the contraction chamber is integrated with the air circulation port. In one exemplary implementation, the supercharger includes a two-piece housing that includes the lower body and the upper lid.

In one exemplary implementation, the attenuation plate is positioned perpendicular to a longitudinal axis of the upper lid and the tuning neck includes a predetermined length in a direction of the longitudinal axis that is configured to attenuate the desired sound frequency. In one exemplary implementation, the predetermined shape of the tuning neck includes an oval shape in a plane perpendicular to the longitudinal axis and parallel to the attenuator plate, where the oval shape together with the predetermined axial length are configured to attenuate the one or more desired sound frequencies.

In one exemplary implementation, the supercharger lid includes a rear wall defining a rear side, a front wall defining a front side, opposed lateral side walls and an upper side defining an interior surface and extending between the rear, front and opposed lateral side walls. In this exemplary implementation, an internal volume of the contraction chamber is defined by the attenuator plate, opposed generally longitudinally extending chamber side walls, the front wall, a lower wall and the interior surface of the upper side. In one exemplary implementation, the attenuator plate and chamber side walls extend from the interior surface of the upper side of the lid.

In one exemplary implementation, the contraction chamber includes a first volume formed by the shape of the tuning neck along its longitudinal length and a second volume formed by the attenuator plate, interior surface, chamber side walls and lower wall, where the first and second volumes are sized to attenuate the one or more desired sound frequencies.

In one exemplary implementation, the upper lid includes a mounting flange surface extending substantially around an outer perimeter of the lid, where a bottom surface of the attenuator plate forms part of the mounting flange. In this exemplary implementation, the mounting flange extends in a same plane and is positioned at a bottom of the rear, lateral side and front walls.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

Figure 1:
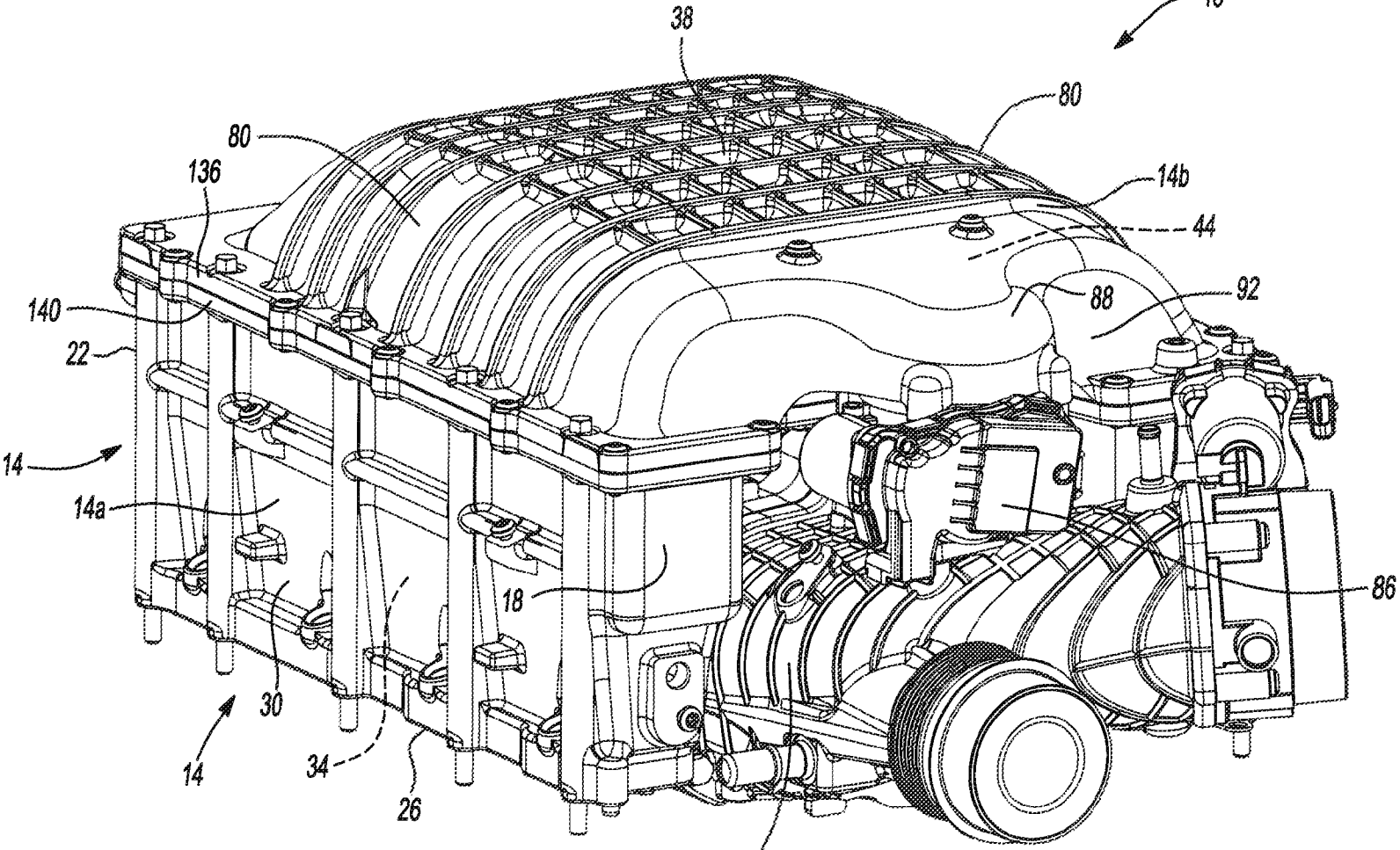
FIG. 1 is a perspective view of an exemplary supercharger according to the principles of the present disclosure.
Figure 2:
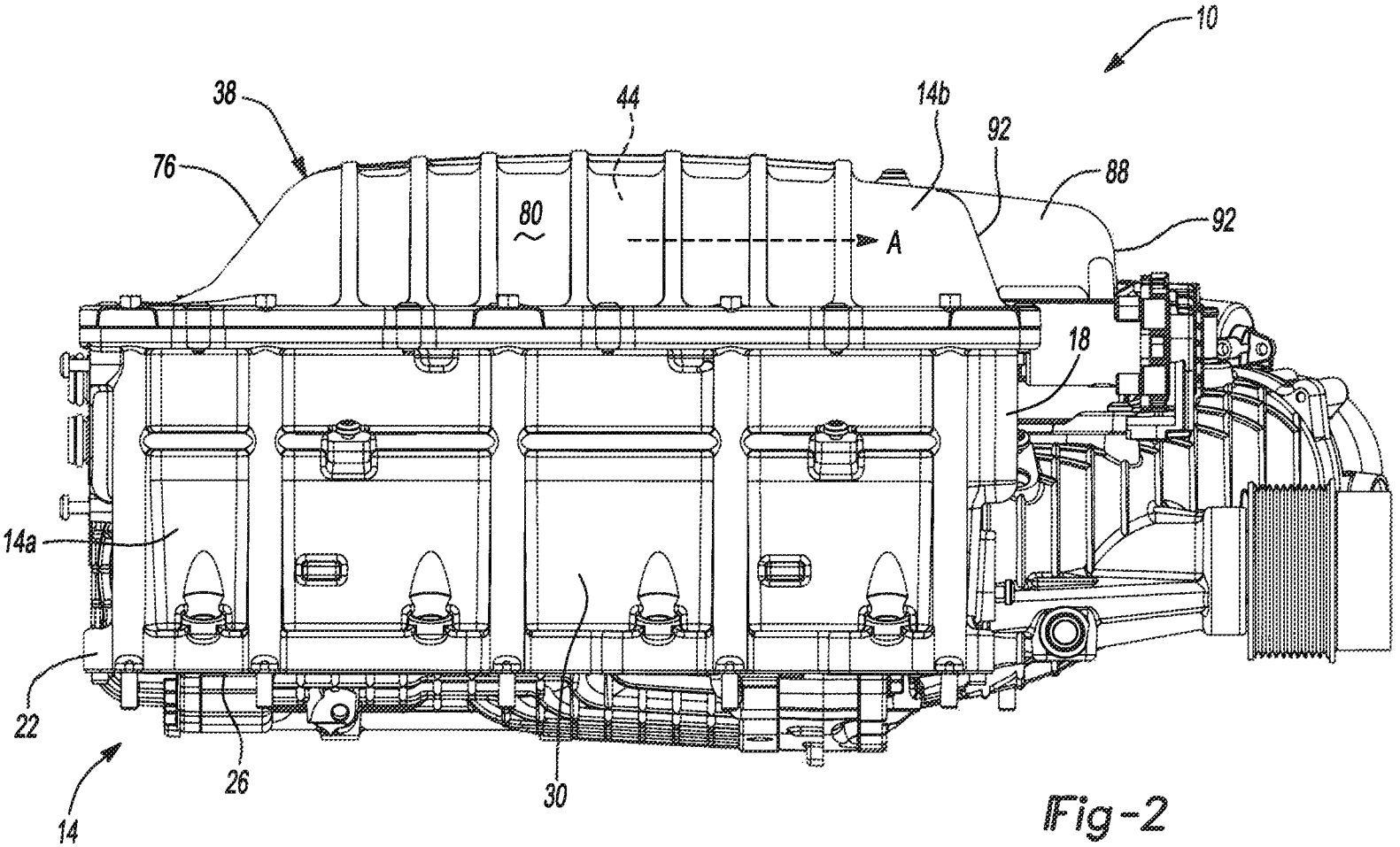
FIG. 2 is a side view of the supercharger of FIG. 1 according to the principles of the present disclosure.
Figure 3:
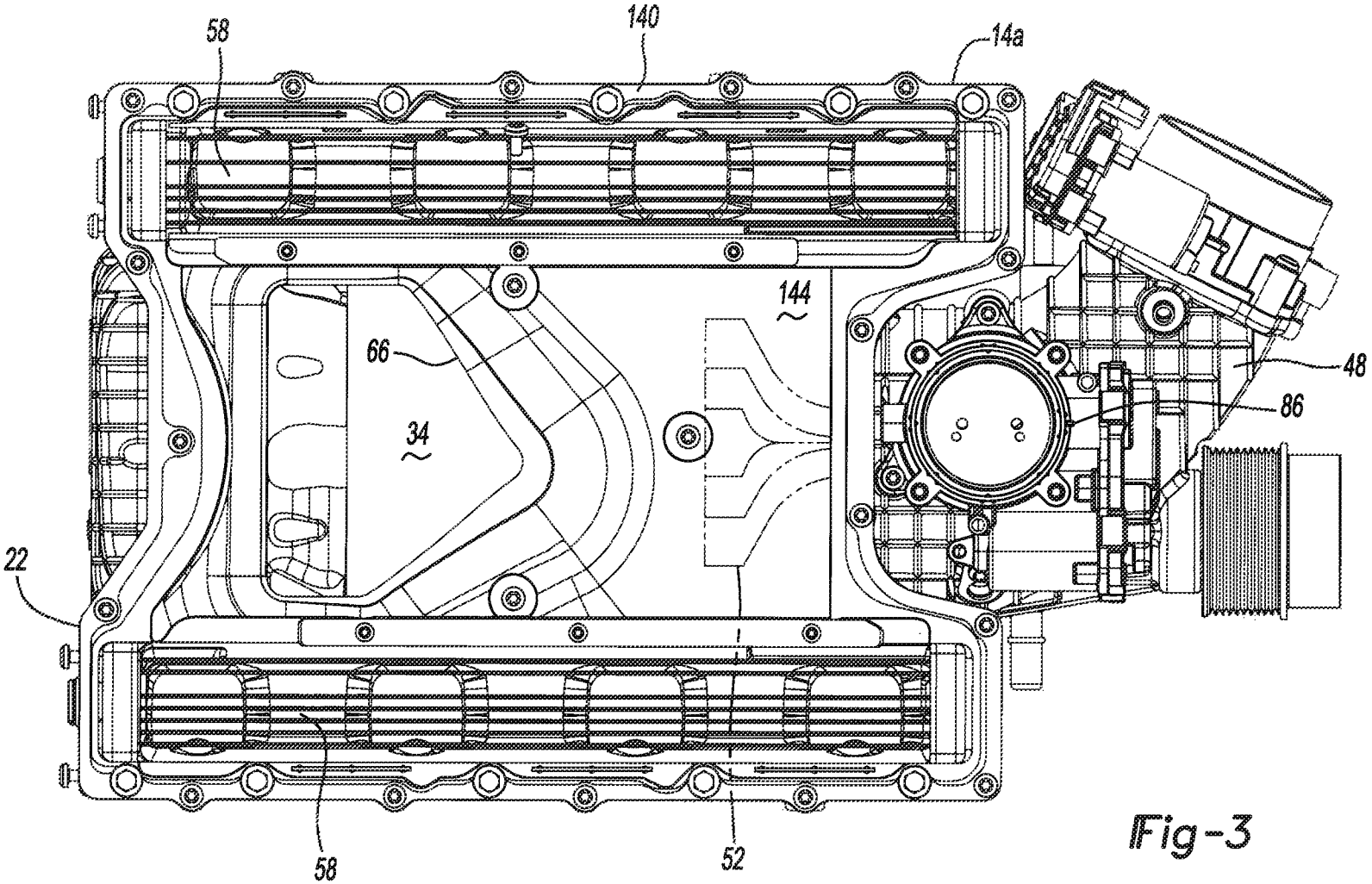
FIG. 3 is a top view of the supercharger of FIG. 1 where a lid or upper housing of the supercharger is removed according to the principles of the present disclosure.

Turning now to the drawings, an exemplary supercharger having an exemplary integrated noise attenuation arrangement is shown and generally identified in FIGS. 1-3 at reference numeral 10. In one exemplary implementation and as will be discussed in greater detail below, an upper housing member or lid of the supercharger includes the integrated noise attenuation arrangement in the form of a contraction chamber to attenuate supercharger generated noise. In the exemplary implementation illustrated, the contraction chamber is positioned adjacent to and upstream of an air circulation port of the supercharger housing such that noise generated by the supercharger in the form of pressure pulsations or sound waves can be attenuated before flowing relative to an intake system of the engine. Integrating the contraction chamber into the supercharger lid provides for attenuating the generated noise close to its source as well as reducing cost and complexity of the supercharger and underhood environment.

Continuing with reference to FIGS. 1-3, supercharger 10 includes a housing 14 having a front or intake side 18, an opposed rear side 22, a bottom side 26, and opposed lateral sides 30, which all include walls defining an internal cavity or compressor area 34. The housing 14 also includes an upper side or housing 38 that together with top portions of the sides 18, 22, 26, 30 defines a plenum 44. In one exemplary implementation, the housing 14 is a multiple-piece housing, such as a two-piece housing, that includes a lower housing or body 14*a* and an upper housing or lid 14*b*. In this exemplary implementation, the lower housing includes sides 18, 22, 26 and 30, and the upper housing or lid 14*b* includes upper side or housing 38. In this exemplary implementation, the upper housing or lid 14*b* is removably sealingly secured to the lower housing 14*a*, as shown for example in FIGS. 1-2.

The supercharger 10 also includes, among other features, an air inlet 48, a compressor 52, and dual integrated charge air coolers 58. In the exemplary implementation illustrated, the air inlet 48 is associated with and/or integrated with the front side 18 of housing 14 and is coupled to an intake system (not specifically shown). The internal cavity or compressor area 34 is in fluid communication with the air inlet 48 and includes compressor 52, which, in an exemplary implementation, includes twin screw rotors, the operation of which is known to those skilled in the art.

Briefly, however, the twin screw rotors compress and move the intake air received into compressor area 34 from air inlet 48. The compressor 52 compresses the air while moving it from the front side 18 of the housing 14, where it is received, to the rear side 22 of the housing. The compressed air exits the internal cavity 34 via an internal passage or high pressure discharge 66 (FIG. 3) and flows into the plenum 44. As mentioned above, the plenum 44 is formed by the supercharger lid 14*b* when it is coupled to the lower housing 14*a*, as will be explained in greater detail below.

The compressed air flowing from the high pressure discharge 66 flows against or relative to an inside surface 72 of the supercharger lid 14*b* where it is split and guided toward each cylinder bank of an associated engine (not shown). For example, the compressed air is guided forward or upstream by the angled configuration of a rear side or wall area 76 of the supercharger lid 14*b* and down toward the charge air coolers 58 for each cylinder bank by the rounded configuration of lateral sides or walls 80 of the supercharger lid 14*b*. The inside surface 72 includes a longitudinally extending rib 84, which aides in splitting the flow toward each charge air cooler 58 and thus each cylinder bank.

The supercharger 10 also includes a bypass valve 86 controllable to allow compressed air flowing into the plenum 44 via the high pressure discharge 66 to exit the plenum 44 via an air circulation port 88 integrated into the supercharger lid 14*b*. Once the air exits through the air circulation port 88, the air flows or recirculates back through the air inlet 48 and into internal cavity 34. In one exemplary implementation, the air circulation port 88 is integrated in the supercharger lid 14*b* at a front side or wall 92. In the exemplary implementation illustrated, the air circulation port 88 is integrally formed with the supercharger lid 14*b*, such as via a casting process, and forms part of the front side or wall 92 of lid 14*b*, as can be seen in the various figures of the application.

The upper side 38 of supercharger lid 14*b* extends along a longitudinal axis for a longitudinal length from the rear side 76 to the front side 92 and between the lateral sides 80, as can be seen in the various figures. In one exemplary implementation and for discussion purposes, the upper side 38 can be portioned into the rear side or wall 76, the front side or wall 92 and the lateral side walls 80 and will be discussed hereinafter as extending between the rear, front and lateral side walls 76, 92, 80 respectively.

As briefly discussed above, pressure pulsations inherent to operation of the supercharge 10 can result in undesirable noise, especially as such pulsations travel into the plenum 44 toward and through the air circulation port 88, because the pulsations can then also travel at least partially into the intake system. As a result, a contraction chamber 100 is incorporated into the supercharger lid 14*b* adjacent the air circulation port 88 for attenuating a certain sound frequency or frequencies caused by the pressure pulsations traveling in the plenum 44 from the rear side 76 to the front side 92. As is generally known, contraction chambers can be used to attenuate vehicle noise and vibrations.

With additional reference to FIGS. 4-9 and continuing reference back to FIGS. 1-3, the contraction chamber 100 will now be discussed in greater detail. In the exemplary implementation illustrated, the contraction chamber includes a neck 104 in fluid communication with and part of an associated subsequent chamber 108, which is in fluid communication with the air circulation port 88. In one exemplary implementation, and as illustrated in the exemplary figures, the contraction chamber 100, which includes the neck 104 and chamber 108, is integrally formed with and integrated with the air circulation port 88. In this exemplary implementation, there is not a wall or other structural separation between the contraction chamber 100 and the air circulation port 88. In the exemplary implementation illustrated, the contraction chamber is positioned entirely in the supercharger lid 14*b*.

The neck 104 includes a predetermined shape 112 and a predetermined longitudinal length 116, each of which are tuned to attenuate a specific sound frequency or frequencies associated with operation of supercharger 10. In the exemplary implementation illustrated, it was discovered that an oval shape 112 having a longitudinal length in a direction perpendicular to the longitudinal length/axis of the supercharger lid 14*b* provided optimal sound attenuation while also minimizing any disturbance to flow of the air in plenum 44. In other words, the oval shape 112 is formed along a plane that is perpendicular to the longitudinal axis and parallel to an attenuator plate 130 (discussed below) of contraction chamber 100.

As mentioned above, the contraction chamber 100 is integrated into the supercharger lid 14*b* such that the lid 14*b* is a unitary component. This reduces cost and complexity of the supercharger as well as does not require use of valuable packing space in the under-hood environment. The contraction chamber is formed by a portion of the upper side 38 of the lid 14*b* that forms interior surface 72, side walls 126 and an attenuator plate or wall 130, in which neck 104 is formed and/or positioned.

In the exemplary implementation illustrated, each of the walls 126 and plate 130 extend from the interior surface 72 and terminate in a sealing or mounting flange 136, which sealingly engages a mating flange 140 (FIG. 3) of lower housing 14*a* when the supercharger lid 14*b* is assembled to the lower housing 14*a*. In one exemplary implementation, the mounting flange 136 extends around or substantially around a perimeter of the lid 14*b* and in a same plane. The attenuator wall 130 is spaced apart from front side or wall 92, as shown for example in FIG. 8. In the exemplary implementation illustrated, the attenuator plate 130 is positioned perpendicular or substantially perpendicular to the longitudinal axis of the lid 14*b*.

When the lid 14*b* is in an assembled position on supercharger 10, the interior surface 72 of top side 38 is spaced apart from a top surface 144 of the lower housing 14*a*, thus forming plenum 44. The walls 126 and attenuator plate 130 of contraction chamber 100 extend downward, when the lid 14*b* is in the installed position, in a direction from the interior surface 72 toward the top surface 144 and terminate in and form part of the sealing flange 136. A lower wall 148 positioned between a portion 136*a* of sealing flange 136 associated with attenuator plate 130 and the front wall 92 form the remaining wall of the contraction chamber 100. In one exemplary implementation, part of the air circulation port 88 also forms part of the remaining portion of the contraction chamber 100.

Figure 4:
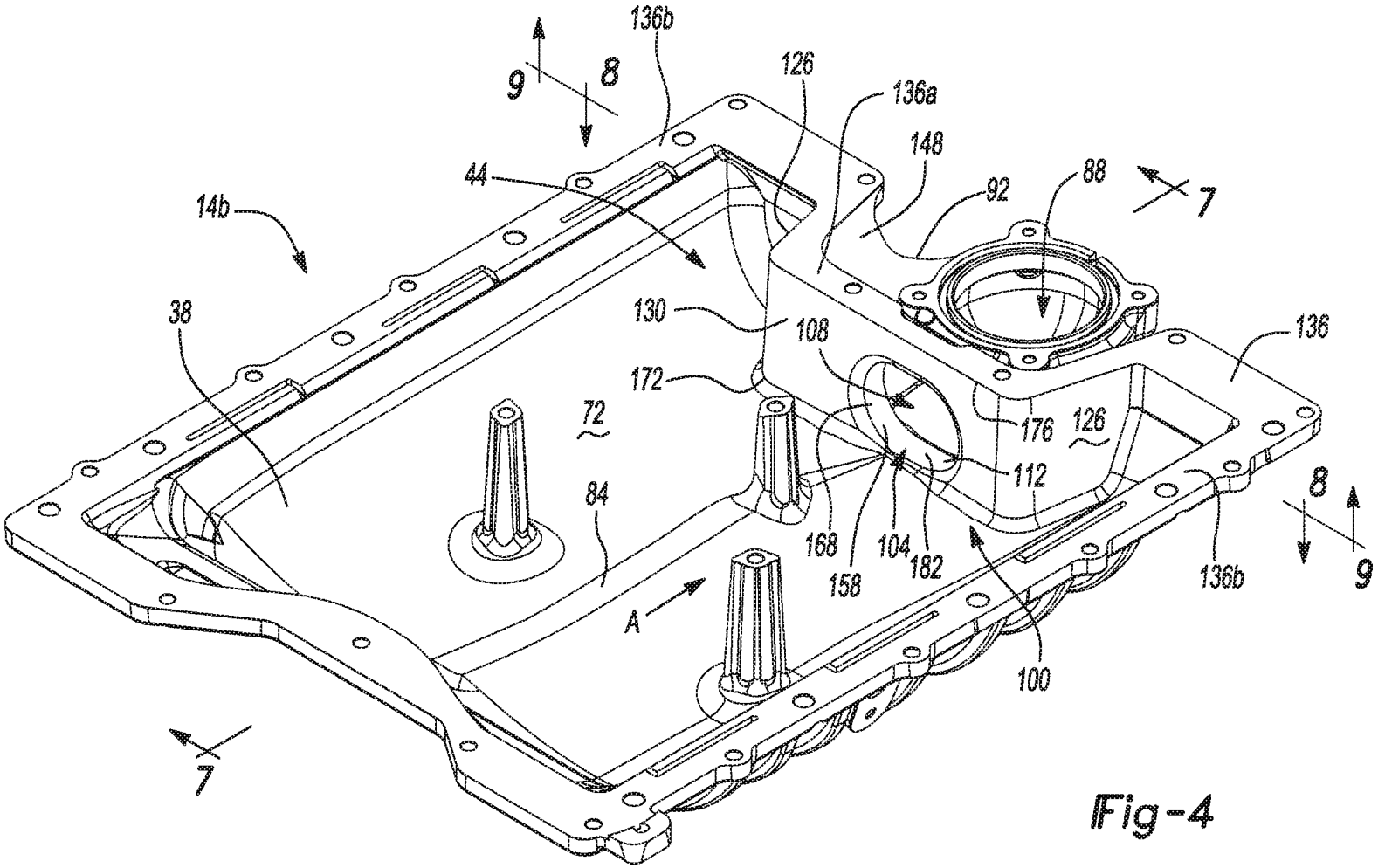
FIG. 4 is a perspective view of an inside or underside of the lid of the supercharger and showing an exemplary noise attenuation arrangement according to the principles of the present disclosure.
Figure 5:
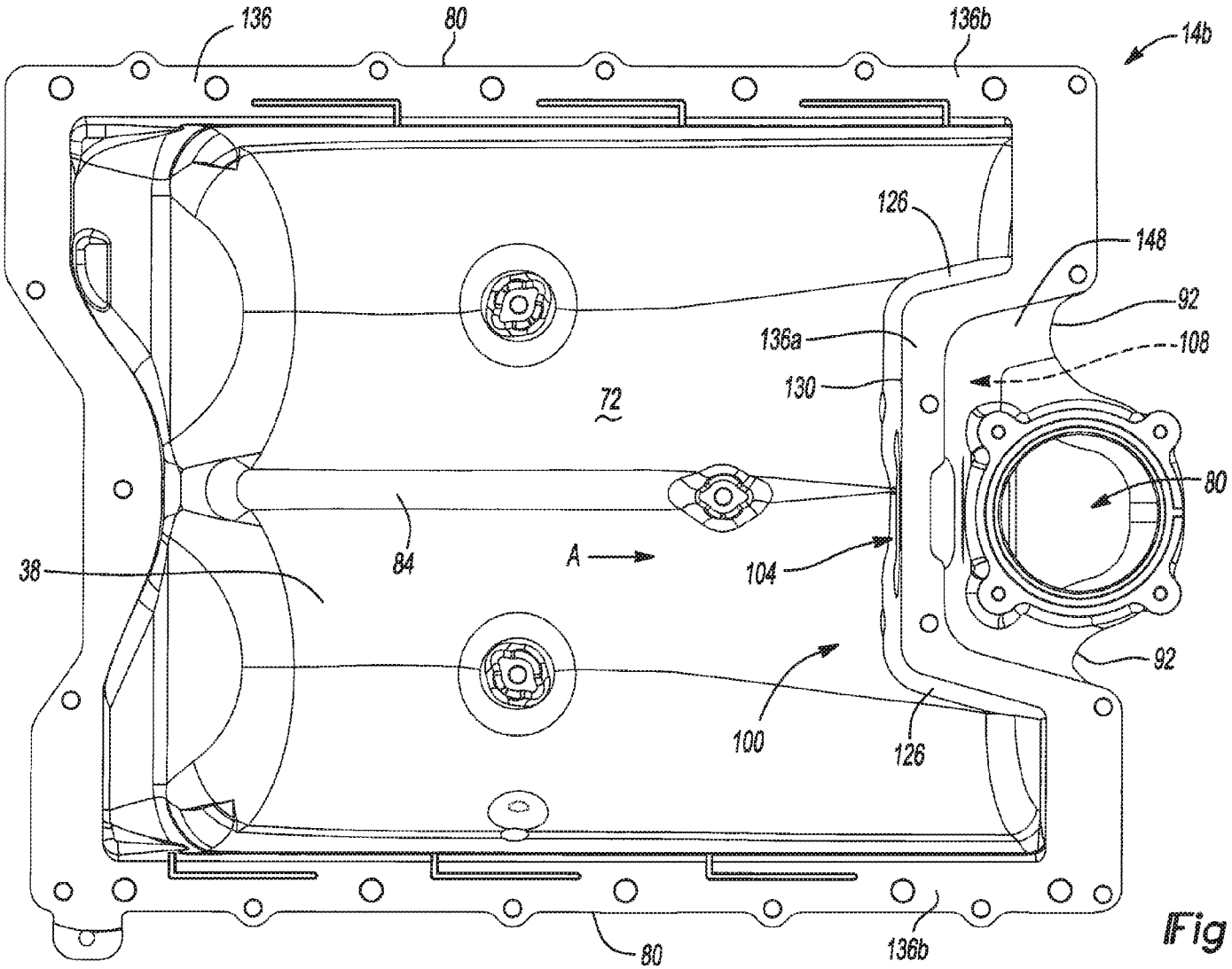
FIG. 5 is a bottom view of the lid of the supercharger and showing the exemplary noise attenuation arrangement according to the principles of the present disclosure.
Figure 7:
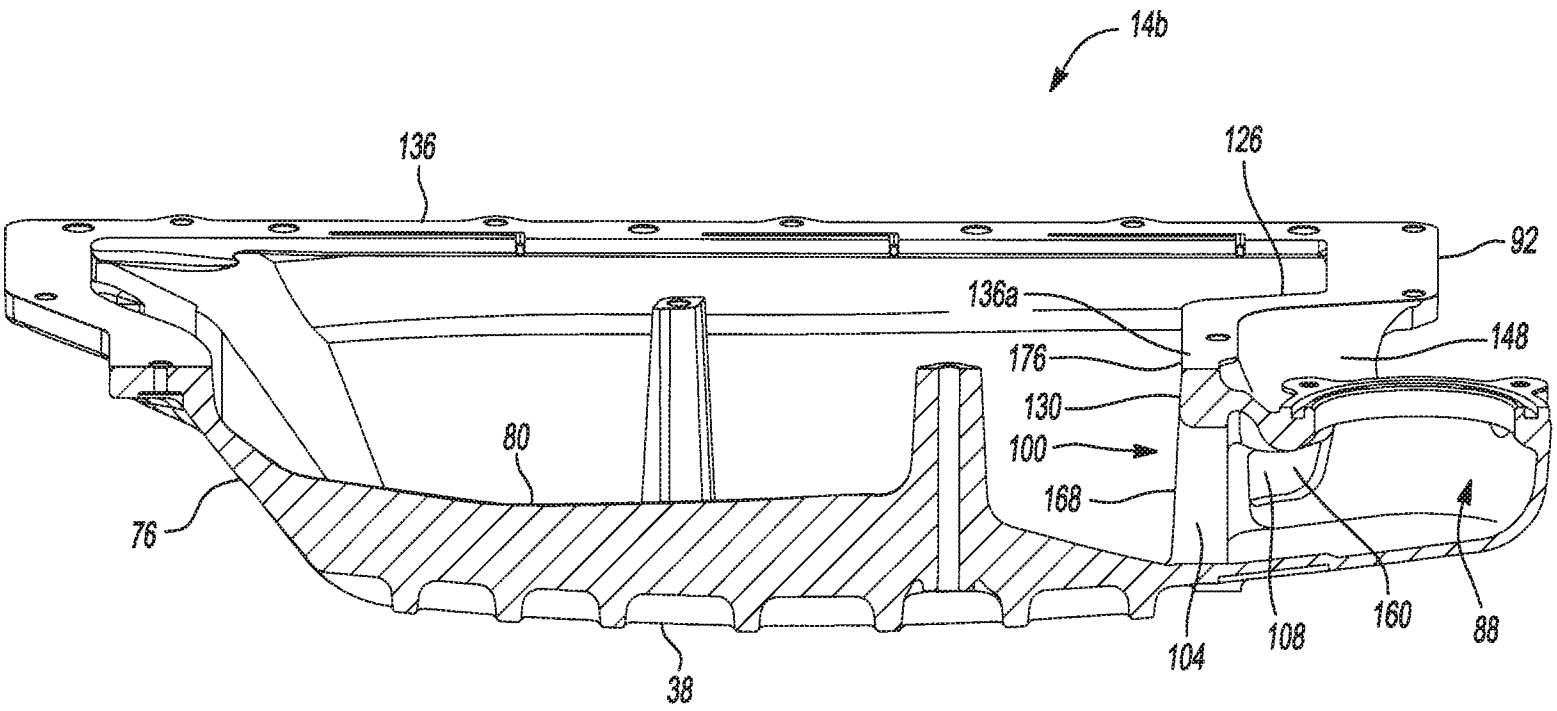
FIG. 7 is a sectional view of the supercharger lid and noise attenuation arrangement integrated therein along line 7-7 of FIG. 4 according to the principles of the present disclosure.

The lower wall 148, in one exemplary implementation, is generally parallel to an opposed portion of interior surface 72 while being spaced apart therefrom, as can be seen in FIG. 7 with reference to FIG. 4. The lower wall 148 also extends in front of sealing flange 136 between attenuator plate 130 and front wall 92. In the exemplary implementation illustrated, the side walls 126 extend substantially longitudinally and are spaced inwardly from and substantially along the same direction as adjacent longitudinally extending portions 136*b* of sealing flange 136.

Figure 6:
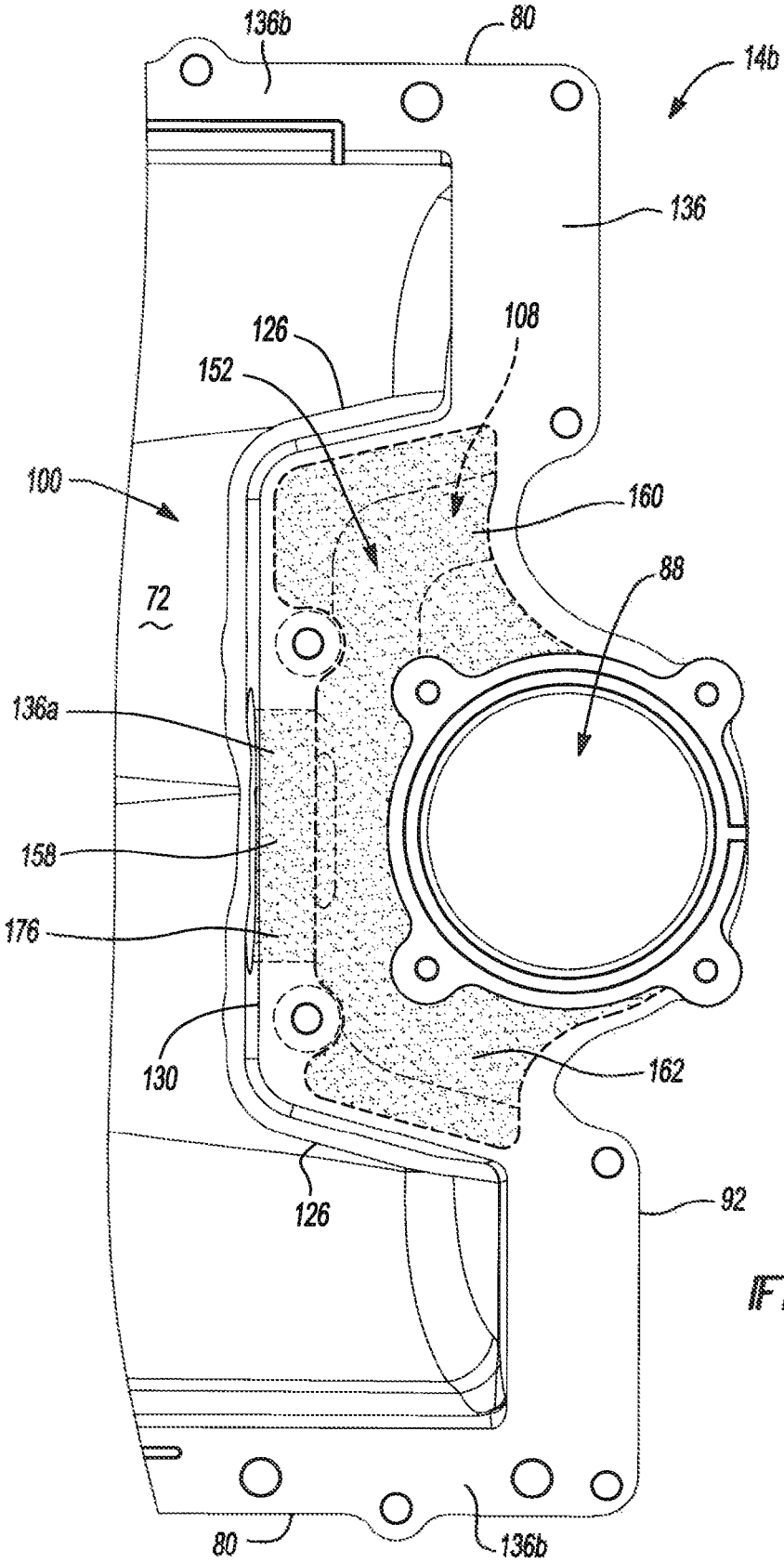
FIG. 6 is a partial view of the supercharger lid of FIG. 5 showing, via a dotted pattern, an inside space of the exemplary noise attenuation arrangement according to the principles of the present disclosure.
Figure 8:
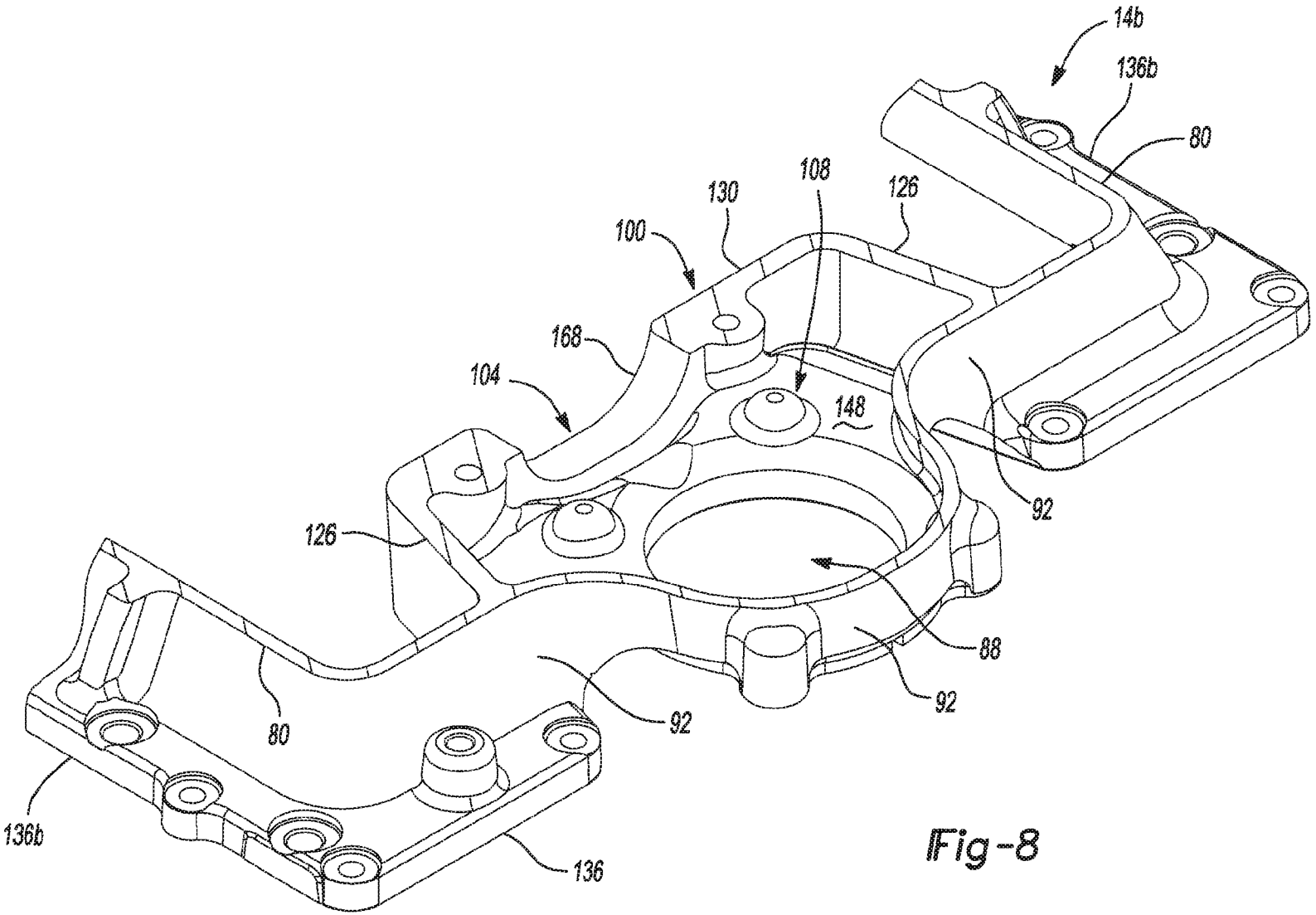
FIG. 8 is a sectional view of the supercharger lid and noise attenuation arrangement integrated therein along line 8-8 of FIG. 4 according to the principles of the present disclosure.
Figure 9:
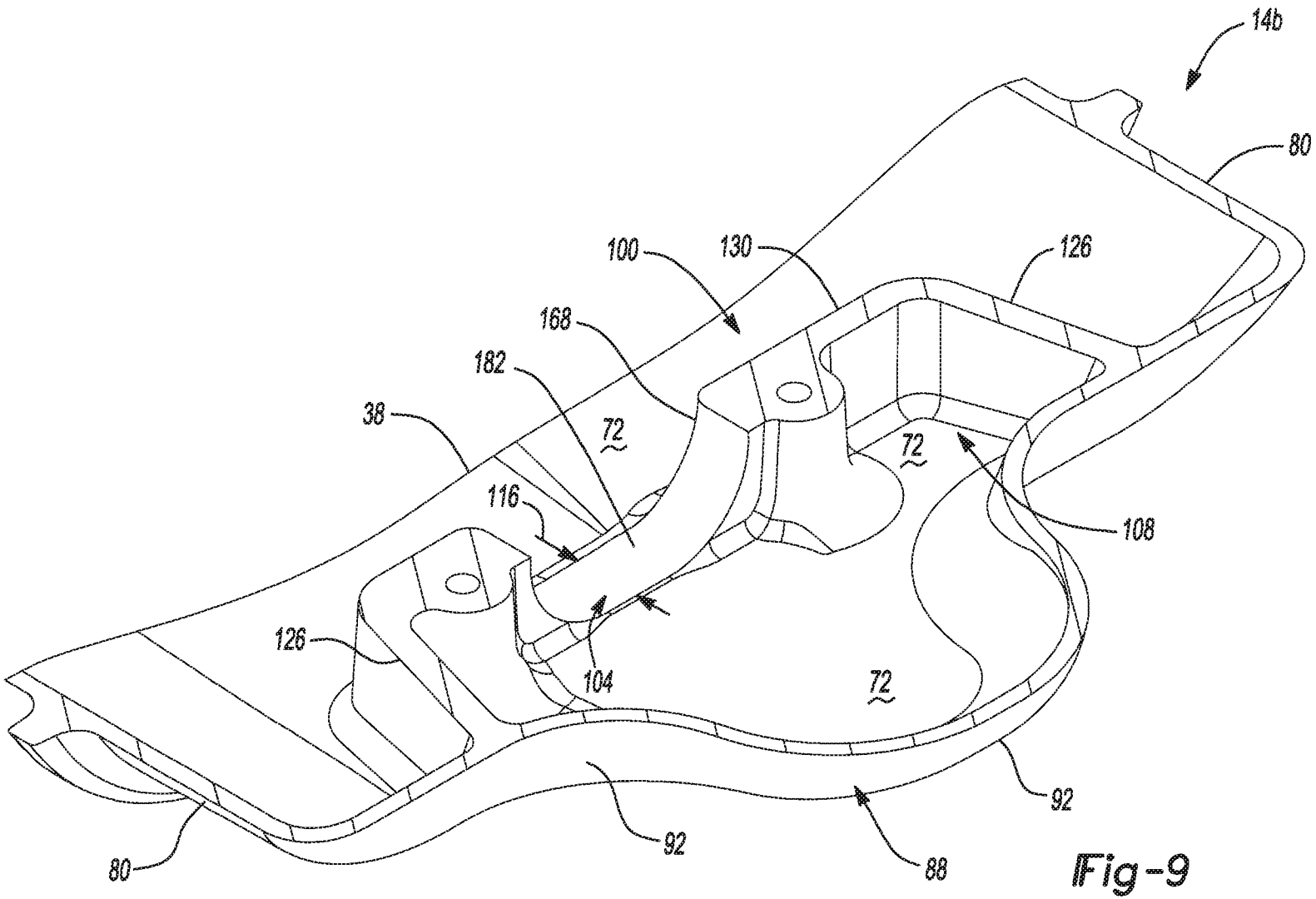
FIG. 9 is a sectional view of the supercharger lid and noise attenuation arrangement integrated therein along line 9-9 of FIG. 4 according to the principles of the present disclosure.

The contraction chamber includes an overall internal volume 152 defined by a volume 158 of tuned neck 104 that is defined by the size, shape and axial length of neck 104 and a volume 160 of the remaining portion of the chamber 100 (i.e., chamber portion 108), which is generally illustrate in FIG. 6 by the dotted pattern 162 and with reference to FIGS. 8 and 9. In the exemplary implementation illustrated, the neck 104 defines an oval opening 168 in and through the attenuator plate or wall 130, as discussed above. In the exemplary implementation illustrated, the neck 104 and opening 168 are positioned at an upper side 172 of attenuator plate 130 and spaced apart from a lower side 176 of attenuator plate 130 that forms a portion of sealing flange 136. In the exemplary implementation illustrated, the volume 160 of the portion 108 of contraction chamber 100 is greater than the volume 158 of the portion of contraction chamber 100 defined by the tuned neck 104.

In one exemplary implementation, an upper side 182 of opening 168 is flush or substantially flush with interior surface 72 of upper side 38. This configuration was discovered to provide optimal sound attenuation while minimizing any restriction of air flow through the air circulation port 88, which travels, at least in part, along interior surface 72.

In operation, as pressure pulsations travel toward and into the contraction chamber, such as along the direction of arrow A (FIG. 4), these pulsations are communicated to tuning neck 104 and directly to the internal volume 158, 160 defined by the contraction chamber 100. The contraction chamber 100 is thus positioned to attenuate a desired sound frequency or frequencies communicated thereto by the supercharger 10 operation and before such pulsations and associated frequencies enter the air circulation port 88 and downstream intake system.

The contraction chamber 100 is formed integrally with the supercharger lid 14*b* thus not requiring any external connections or supplemental components for mounting. Moreover, the contraction chamber is less complex and more effective at noise attenuation than conventional externally mounted attenuation devices or chambers. The compact nature of contraction chamber 100 provides for the chamber to be formed entirely in and/or internal to the lid and in close proximity to the source of supercharger noise generation, thereby providing for optimal sound/noise attenuation. Further, the contraction chamber 100 utilizes some of the existing interior surfaces of the supercharger lid to form its chamber walls while also incorporating a sealing flange therewith to further reduce size and weight of the supercharger lid. Conventional expansion chambers and/or resonators included in intake systems typically require add-on connections, such as hoses, and also require fabrication of a six-wall box structure that does not utilize existing walls of the intake box or structure.

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. A supercharger for a vehicle, the supercharger comprising:

a lower body housing a compressor;

an upper lid configured to be coupled to the lower body thereby forming a plenum, the upper lid defining an air circulation port, the upper lid extending along a longitudinal length from a rear side to an opposed upstream front side and between opposed lateral sides, the air circulation port being disposed at the front side; and a contraction chamber integrally formed in the upper lid adjacent to the air circulation port, the contraction chamber including an attenuator plate defining a tuning neck, the tuning neck defining an inlet to and part of a volume of the contraction chamber;

wherein the tuning neck includes a predetermined size and shape configured to attenuate a desired sound frequency generated by operation of the supercharger;

wherein the attenuation plate is positioned perpendicular to a longitudinal axis of the upper lid that extends parallel to the longitudinal length, and the tuning neck includes a predetermined length in a direction of the longitudinal axis and an oval shape.

2. The supercharger of claim 1, wherein the contraction chamber is positioned entirely in the upper lid.

3. The supercharger of claim 1, wherein the predetermined shape of the tuning neck includes the oval shape in a plane perpendicular to the longitudinal axis and parallel to the attenuator plate, the oval shape together with the predetermined axial length being configured to attenuate the desired sound frequency.

4. The supercharger of claim 1, wherein the supercharger lid includes a rear wall defining the rear side, a front wall defining the front side, opposed lateral side walls and an upper side defining an interior surface and extending between the rear, front and opposed lateral side walls; and wherein an internal volume of the contraction chamber is defined by the attenuator plate, opposed generally longitudinally extending chamber side walls, the front wall, a lower wall and the interior surface of the upper side.

5. The supercharger of claim 4, wherein the chamber side walls extend from the front wall rearwardly to the attenuator plate and are spaced inwardly from the upper lid lateral side walls.

6. The supercharger of claim 4, wherein the attenuator plate and chamber side walls extend from the interior surface of the upper side of the upper lid.

7. The supercharger of claim 4, wherein the contraction chamber includes a first volume formed by the shape of the tuning neck along its longitudinal length and a second volume formed by the attenuator plate, interior surface, chamber side walls and lower wall, the first and second volumes being sized to attenuate the desired sound frequency.

8. The supercharger of claim 7, wherein the second volume is larger than the first volume.

9. The supercharger of claim 7, wherein the contraction chamber is integrated with the air circulation port.

10. The supercharger of claim 9, wherein the attenuator plate is spaced apart from the front wall such that air flowing through the air circulation port from the compressor flows through the first volume of the contraction chamber, then through the second volume of the contraction chamber and then through the air circulation port.

11. The supercharger of claim 9, wherein the upper lid includes an absence of a wall between the contraction chamber and the air circulation port.

12. The supercharger of claim 4, wherein the upper lid includes a mounting flange surface extending substantially around an outer perimeter of the upper lid; and wherein a bottom surface of the attenuator plate forms part of the mounting flange, the bottom surface of the attenuator plate being opposed to an upper surface of the attenuator plate mating with the interior surface of the upper side of the upper lid.

13. The supercharger of claim 12, wherein the mounting flange extends in a same plane and is positioned at a bottom of the rear, lateral side and front walls.

14. The supercharger of claim 12, wherein the lower wall of the contraction chamber is spaced apart from the interior surface of the upper side and extends in front of the mounting flange from the attenuator plate to the front wall.

15. The supercharger of claim 12, wherein the contraction chamber is positioned entirely in the upper lid and extends between the upper side and mounting flange of the upper lid.

16. The supercharger of claim 1, further comprising a two-piece outer housing formed by the lower body and the upper lid.

* * * * *